US006289703B1

(12) United States Patent
Kress et al.

(10) Patent No.: US 6,289,703 B1
(45) Date of Patent: Sep. 18, 2001

(54) RASHEL MACHINE WITH A STROKE DEVICE FOR A GUIDE BAR ASSEMBLAGE

(75) Inventors: Edgar Kress, Hof; Karl-Heinz Roth, Naila, both of (DE)

(73) Assignee: Liba Maschinenfabrik GmbH (DE)

( * ) Notice: Subject to any disclaimer, the term of this patent is extended or adjusted under 35 U.S.C. 154(b) by 0 days.

(21) Appl. No.: 09/301,265

(22) Filed: Apr. 29, 1999

(30) Foreign Application Priority Data

Oct. 26, 1998 (DE) ..... 198 49 289

(51) Int. Cl.[7] ..... D04B 27/26
(52) U.S. Cl. ..... 66/207; 66/203
(58) Field of Search ..... 66/203, 204, 207, 66/208, 87, 90, 125 R

(56) References Cited

U.S. PATENT DOCUMENTS

| | | | | |
|---|---|---|---|---|
| 2,786,344 | * | 3/1957 | Lambach et al. | 66/207 |
| 3,802,226 | * | 4/1974 | Kohl | 66/204 |
| 5,311,751 | * | 5/1994 | Winter et al. | 66/207 |
| 5,542,270 | * | 8/1996 | Mista et al. | 66/207 |

FOREIGN PATENT DOCUMENTS

| | | |
|---|---|---|
| 959939 | 3/1957 | (DE) . |
| 2010602 | 9/1970 | (DE) . |
| 2002700 | 11/1971 | (DE) . |
| 41 29 723 C2 | 9/1993 | (DE) . |
| WO98/26120 | 6/1998 | (WO) . |

* cited by examiner

*Primary Examiner*—Danny Worrell
(74) *Attorney, Agent, or Firm*—Banner & Witcoff, Ltd.

(57) ABSTRACT

A rashel machine is described for the production of a knitted fabric, especially on a double bar or multi-bar rashel machine which includes a knitting needle bar and a guide bar assemblage having several guide bars therein. The guide bar assemblage is supported on a shaft that has a rotationaL axis that can be adjusted relative to the knitting needle bar essentially in the direction of its stroke movement. According to the invention, the rotational axis is adjustable between a first position and a second position by way of an adjustment mechanism, whereby in a first position a threading-in of a thread into the hole of the guide needle is easily possible even with guide bars lying on the inside without having to disconnect the guide bars lying on the outside of the guide bar assemblage. Furthermore, the rotational axis is adjustable from its second position by way of the adjustment mechanism into a knitting-technical predetermined position wherein the guide bar assemblage can finely be adjusted with respect to the knitting needle bar.

8 Claims, 7 Drawing Sheets

- Pos. ①-

- Pos. ② -

RASHEL MACHINE WITH A STROKE DEVICE FOR A GUIDE BAR ASSEMBLAGE

The invention is concerned with a rashel machine having a stroke device for a guide bar assemblage, especially for a double needle or multi-bar rashel machine.

BACKGROUND OF THE INVENTION

With regard to double needle bar or multiple needle bar rashel machines, several guide bars are combined in a guide bar assemblage. During the stitch forming phase, a cyclical rotation around the rotational axis of the guide bar assemblage occurs which results in a pivoting motion. However it is also possible that the guide bar assemblage is at a standstill and the knitting needles undergo a corresponding relative movement. The pivot and laying movements that are responsible for laying the threads around the knitting needles are generally executed by the guide needles that are arranged on the guide bars and thereby the entire guide bar assemblage follows the movement, while the knitting needles as a rule, essentially only undergo stroke movements. In any event, there a relative movement involved between the knitting needles and the guide needles whereby the guide needles execute a knitting-technical stroke movement.

From DE-PS 959939 it is known to arrange for a height adjustment of a single guide bar by providing guide rods which are supported in bearings on the guide bar by which the guide bars are manually adjustable with respect to their heights. The adjustment of the height position of the known warp knitting machine for the adjustment of the necessary height with regard to the adjustment of the casting-off from the knitting needles is realized in that a pivot trunnion can adjustably be pivoted by the provision of an adjusting screw. A considerable disadvantage in the known arrangement consists in that the adjustment is made manually which does not conform to nowaday's mandates of a high precision adjustment in the respective and desired positions and in a quick manner. Furthermore, because of the pivot motion only relative small and only knitting-technical height adjustments can be realized resulting in a construction which is quite involved and difficult. The adjustment of a complete guide bar assemblage consisting of several guide bars is not possible.

From DE 41 29 723 C2 it is known to provide a warp knitting machine having knitting needles with at least one guide bar whose guide needles undergo a a pivot and laying movement which is derived from the main shaft which results in a relative movement between the knitting needles and the guide needles to thereby lay the knitted threads around the knitting needles. The guide needles undergo an additional movement essentially in the stroke direction of the knitting needles. This stroke movement involves only a very short time period for the respective guide bar to undergo its stroke by way of which the rise and fall in the speed of the knitting needles should be evened out. A further considerable stroke movement of the guide needle bar assemblage during the standstill of the machine has not been described.

DE-OS 20 02 700 describes an arrangement, especially for rashel machines, for the laying of blind layings and/or for the knitting-in of thicker yarns into a basic fine gauge knitting. For this purpose, one or more guide bars undergo a stroke movement, besides their normal swing and rack movement, by way of which the guide needles of the guide bars are being lifted above the heads of the knitting needles (latch needles). This stroke movement serves for the execution of the pattern mandated movements and results in the so-called "fallblechlegungen", respectively serves for the working with thicker threads.

DE-OS 20 10 602 describes an arrangement for rashel machines which makes possible a lift and lowering of one or several pol guide bars. The lift and lowering movement of one or several pol guiding bars is in addition to their pivot and laying movement results in the production of blind layings when plush or velour is being knitted, that is, in the production of so-called "fall blech" layings. The adjustment of the height of the guide bar is only possible during the operation of the machine and then it is only possible with a small pattern mandated shift in height.

Furthermore, from WO 98/26120, a control arrangement for the movement of knitting elements on warp knitting machine is known in which, because of a knitting-technical condition, a guide bar assemblage realizes the necessary stroke for the knitting movements and the cast-off of the stitches by way of a shifting device which is operable either when the machine is at standstill or when it is operating.

Especially with multi-bar or double bar rashel machines, the threading-in of the threads into the guide needles having holes therein is extremely difficult, especially with respect to the innermost positioned guide bar because of the narrow space. Many times it is necessary to disassemble the outer guide needle fitting or the entire guide bar which results in a considerable expenditure of time. Because of the fact that the threading-in of the threads has to be done when the machine is at a standstill, a considerable loss in production is also experienced.

Furthermore, with the so-called double needle bar machines, an adjustment of the space between the two so-called cast-off edges is necessary in order to be able to produce fabrics having different thicknesses. Because of the known machine structure, a change in the cast-off position in the vertical direction is necessary which results in a change of height for all of the knitting elements. Most of all, to change the height position of the guide bars in the known machines is quite involved constructively and expensive because all of the axial supports of the guide bars have to be disconnected and thereafter have to screwed on again. Because of the precision of this activity, a large amount of time is being expended including the requirement of experts.

OBJECTS OF THE INVENTION

An object of the invention is to create a rashel machine, especially a double needle bar or a multiple bar rashel machine by way of which the entire guide bar assemblage can be shifted from the required knitting position to such an extent so as to enhance the accessibility even to the innermost positioned guide needles for the threading-in of threads and to thereby increase the maintenance friendliness and to thereafter shift back into the position that is necessary for a knitting operation with a high precision, whereby the shifting, that is, adjustment of the guide bar assemblage can be undertaken easily and quickly.

According to the invention there is a rashel machine , especially a double needle or a multi-bar rashel machine with at least one knitting needle bar and several guide bars, preferably four to eight, having guide needles with holes thereon, and being supported on a shaft as a multi-bar assemblage. The rotational axis of the guide bar assemblage is adjustable with regard to the knitting needle bar essentially in the direction of the stroke of the knitting needle bar when the machine is at a standstill. According to the invention, the rotational axis of the guide bar assemblage is adjustable to a certain space between a first position and a second position by way of an adjusting mechanism which preferably can be activated by switching impulses, whereby in a first position the threading-in of a thread into a guide needle is possible be it as result of a thread break or the required threading-in at the beginning of the knitting process of a new fabric, even the innermost positioned guide bar can be threaded without having to disassemble the outer guide bars of the guide bar assemblage. Furthermore, the guide bar assemblage is adjustable from the second position by way of the adjusting mechanism in which the guide bar assemblage can be fine tuned to the knitting-technical predetermined position with respect to the knitting bar. Under a fine tuning of the guide bar assemblage with respect to the knitting needle bar, is to be understood the correlation of the maximum height of the top of the knitting needle relative to the hole of the guide needle. This fine tuning normally takes place within a space of several tenth of a millimeter. The basic adjustment is thereby undertaken in such a manner so that the upper edge of the hook of the knitting needle coincides, for example, with the upper inner edge of the hole in the guide needle. In case the fabric thickness is being decreased in spaced knitted fabrics, as is common in double bar rashel machines, the upper edge of the knitting needle is located in its uppermost position just below the upper inner edge of the hole of the guide needle, that is, it deviates from the basic position because of a slight pivoting of the cast-off sinker and the knitting needle bar. The intricate change of the guide bar assemblage is only undertaken, as a rule, at the beginning of the knitting of another or new fabric in such a manner so that all guide needles approach the optimal stroke position of the knitting needles. In case there is a deviation from the optimal base position, a danger exists in that the stitch forming process cannot take place according to rule whereby so-called dropped stitches appear as faults in the knitted fabric. This can also lead to thread breaks.

Thereby, it also possible to effect a fine tuning of the vertical position of the entire guide bar assemblage, for adjustment purposes, by converting to preferably electric or electronic impulses as corresponding to switching steps. This fine tuning, which as a rule, only occurs per knitted fabric, that is, at the beginning of a new run, further serves for the optimal accommodation of the knitting elements to changed and varied thread qualities and respective textile-technical actualities. It is also possible that a quick shift from the knitting-technical mandated position to a threading-in position by way of a relative large stroke in a further switch impulse corresponding to a switching step, whereby the lifting during this last switching step occurs in such a manner so that an easy accessibility is possible for the threading-in of a thread into a guide needle including the innermost located guide bar.

According to a further development of the invention, the adjustment mechanism undergoes a first adjustment phase of the guide bar assemblage which is somewhat smaller than the space in which a threading-in of a thread into a guide of the innermost located guide bar is possible, which is quicker than a second adjustment phase which illustrates the difference between the space of the first adjustment phase when the adjustment mechanism of the guide bar assemblage fine tunes with respect to the needle bar and its knitting-technical mandated position. The second adjustment phase is thereby executed by a further switching impulse which corresponds to a switching step, Because of this subdividing of the switching paths of the adjustment mechanism and a further switch impulse corresponding to a switching step, all respective requirements can be accounted for. The high exactitude of the adjustment of the position of the guide bar assemblage with respect to the knitting needles can thereby be undertaken with a high precision. The lifting of the guide bar assemblage out of the knitting-technical position, respectively, from the small space distanced therefrom into a position in which the threading-in of the threads into the guide needles including those that are located innermost of the guide bar assemblage, can thereby be undertaken without any high precision, however with a considerable distance, that is, after a considerable stroke movement. After a fine adjustment has taken place, the guide bar assemblage is adjustable from the first position directly and exactly into the predetermined knitting-technical position by way of the adjustment mechanism, whereby the adjustment, preferably is done in one step.

According to a further development example of the invention, the adjustment mechanism includes an adjustable stop whereby the adjustment mechanism can be controlled in such a manner, preferably hydraulically but based on electronic signals, so that the respective adjustment paths in the first switch impulse corresponding to a switching step and a second switch impulse corresponding to a second switching stop are obtained with their respective differently required precision. The respective stop positions are thereby adjusted by way of a caliper gauge.

Preferably, the inventive rashel machine includes a reserve device from which knitting-technical predetermined positions of the guide bar assemblage can be withdrawn. From this reserve device, the respective knitting-technical mandated position is being recalled for the respective fabric to be produced, that is, the respective pattern of the fabric and in the framework of a fine adjustment is forwarded to the adjustment mechanism to the first switch impulse corresponding to the switching step by which the fine adjustment into the knitting-technical mandated position takes place which has been chosen, that is, has been recalled from the reserve device.

According to a further development example, the adjustment mechanism is adjustable by way of hydraulics, pneumatics or respective gearing, respectively, a drive device. However, the adjustment is preferred by way an electric motor, whereby through the use of a servo motor, especially a stepping motor, a very high adjustment exactitude can be achieved which can be matched with the respectively required exactitude of the respective switching steps of the first adjustment path and the second adjustment path. Preferably, the adjustment mechanism should be controllable by way of a signal produced by an electronic control device.

According to a further development of the invention, the stop should preferably be electrically adjustable. Thereby, the stop will be adjusted by way of an additional electrical adjustment device to thereby be able to adjust the stop directly to a respective adjustment path, that is, the adjustment range according to mandates. It is also possible to adjust the stop by of hydraulics.

Further advantages characteristics and possible uses of the invention will be described in detail by having reference to the drawings at hand.

DETAILED DESCRIPTION OF THE DRAWINGS

Figure 1:
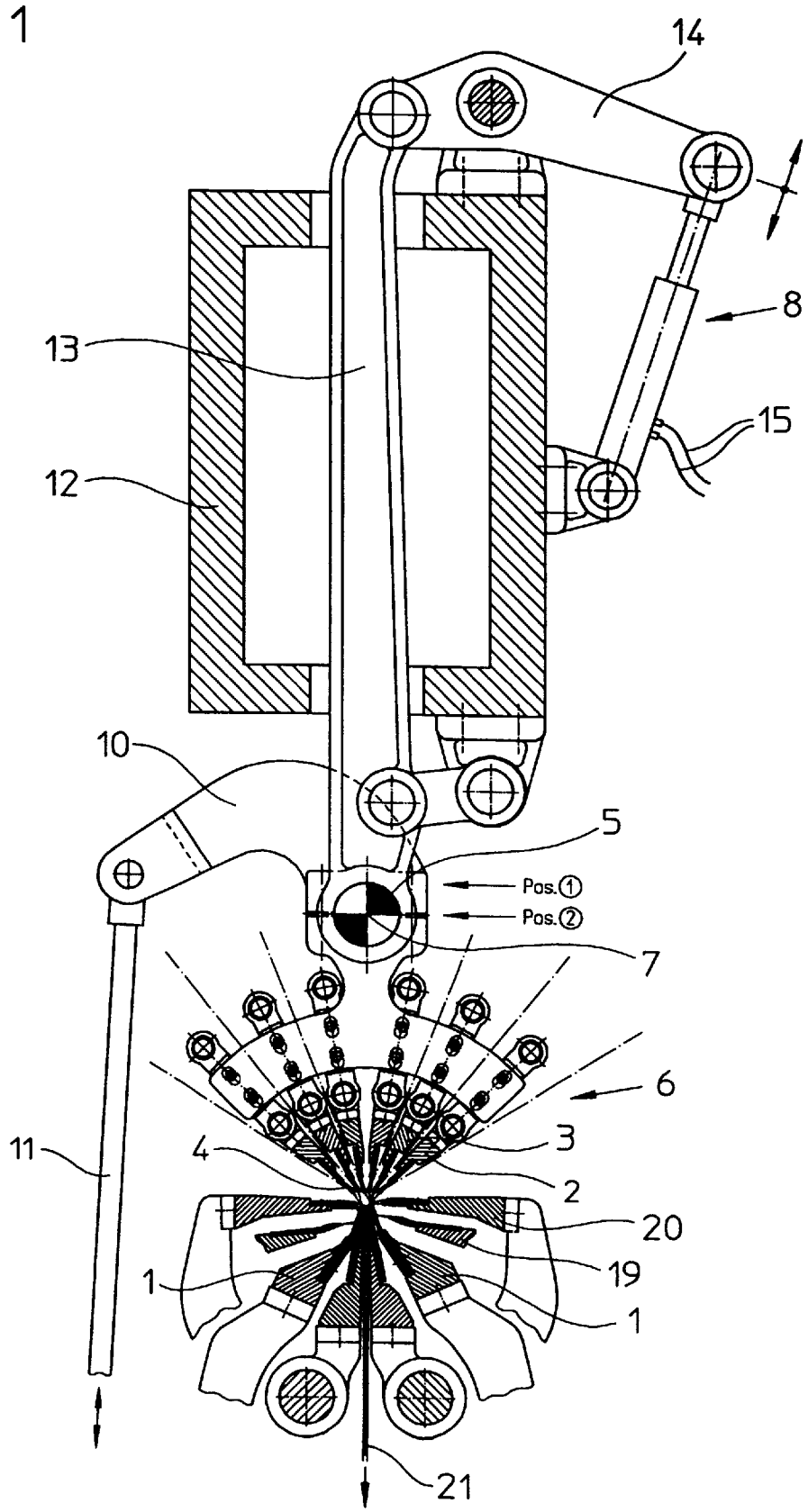
FIG. 1 is a basic side view in detail of a stroke device for a guide bar assemblage of a rashel machine according to a first embodiment of the invention.

FIG. 1 shows a detailed side view of the knitting area and the stroke device of a rashel machine for the adjustment of the distance between the guide bar assemblage and the needle bars. In a known manner it is known that in multi-bar rashel machines two opposing needle bars 1 with their associated pusher bars 19 and their laying comb bars 20 are arranged. Between the cast-off sinkers 33 (FIGS. 3*a* and 3*b*) the already knitted fabric is pulled down and is guided to a not shown winding device. Above the knitting needle bars 1, pusher bars 19 and the laying comb bars 20, a guide bar assemblage 6 has been arranged. The guide bar assemblage 6 includes six guide bars with their respective guide needles. The guide bar assemblage 6 has on each side guide bars 2 positioned on the outside and four guide bars 3 positioned there between.

The guide bar assemblage 6 is pivotably supported on a shaft 5 around a rotational axis 7. The pivotable movement of the guide bar assemblage 6 is initiated by way of a pivot lever 10 which is non-rotationally fastened on the shaft 5. On the opposite side of the pivot lever 10, a push rod 11 is pivotably linked by way of which the knitting-technical mandated swing movement through the spaces between the needles is being realized by way of a not shown drive mechanism such as by cams, for example, which is followed by a movement of the guide bar assemblage 6 in the direction of the rotational axis of shaft 5 followed again by a return movement through the spaces between the needles so that by way of the guide needles and the threads 9 guided in their holes 18 (see FIG. 3*a* as well as FIG. 3*b*) can be laid around their respective needles to form the stitches. Also a stroke adjustment device for the guide bar assemblage 6 is connected, that is, linked to the shaft 5. This stroke adjustment device is supported on a longitudinal machine beam 12. On the upper side of the longitudinal beam 12 a tilt lever 14 is pivotably fulcrumed whereby over the entire machine width, in the direction of the longitudinal machine beam 12, several tilt levers 14 have been arranged but in a shorter machine only one tilt lever 14 will suffice. In one of the tilt lever 14, a connecting element 13 is pivotably linked. This connecting element 13 extends through the longitudinal machine beam 12 and is rigidly connected to the shaft 5 of the guide bar assemblage. On the opposite side of the connecting element 13 of the tilt lever 14 an adjustment device 8 is linked with a first end to the tilt lever and its second end is supported on the outside of the longitudinal machine beam 12. In addition to the swing and pivotal movement of the guide bar assemblage 6 which by way of an oscillating movement of the push rod 11 and the pivot lever 10 is being transferred to the guide bar assemblage 6 and by an adjustment of the adjustment mechanism, that is, by changing the distance between the first end and the second end relative to each other, the rotational axis 7 of the shaft 5 is shifted coaxially, so that the distance of the holes 18 of the guide needles 14 of the guide bar assemblage 6 will be changed relative to the knitting needle bar 1. Lines 15 leading to the adjustment mechanism 8 indicate that the adjustment mechanism 8 is adjustable by way of predetermined signals with respect to the distance between the first end and the second end.

Figure 2:
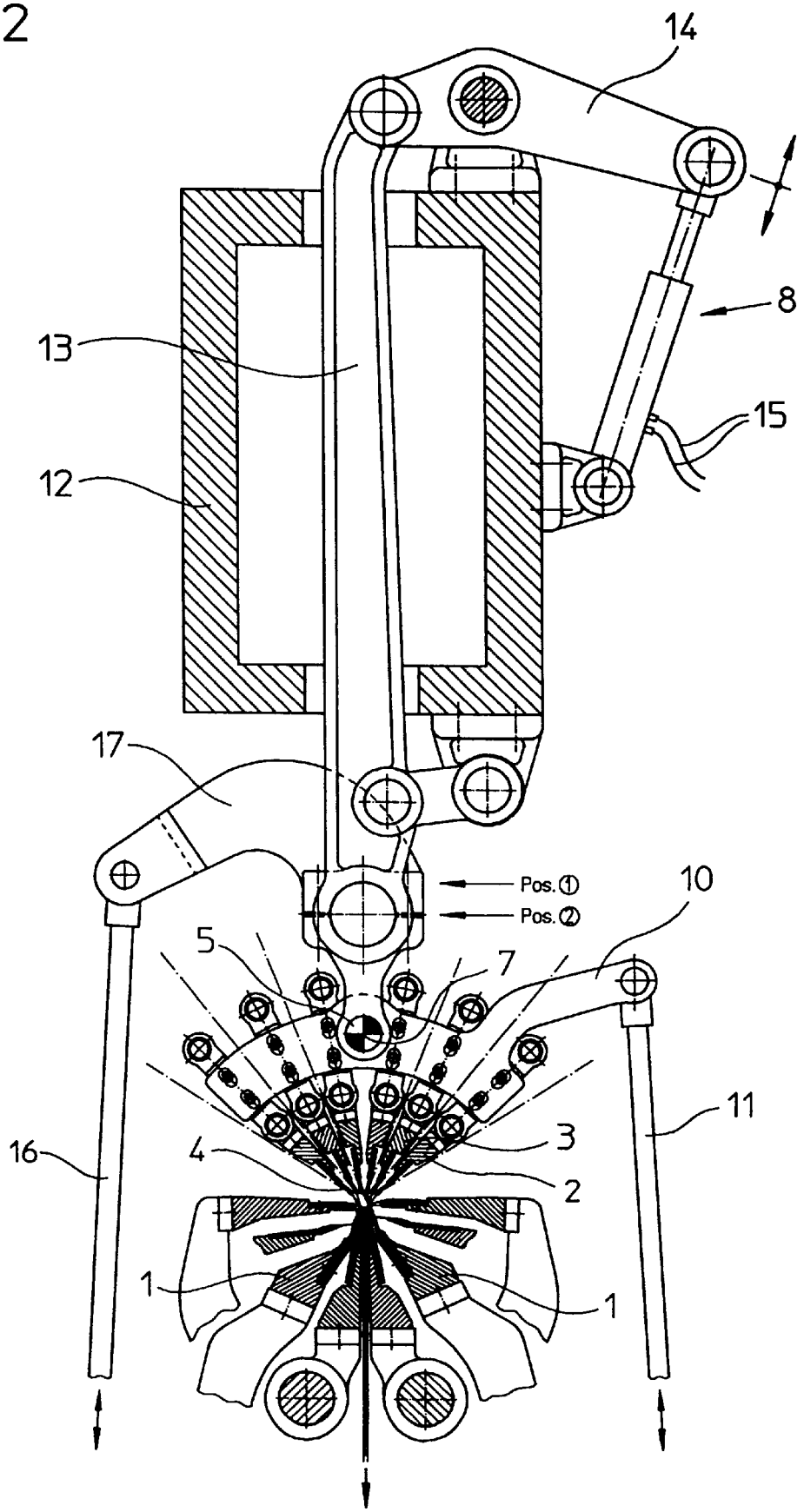
FIG. 2 is a basic side view of a stroke device for a guide bar assemblage according to a second embodiment of the invention.

FIG. 2 shows an example of a further development having principally the same basic construction as was described with regard to FIG. 1. By way of the adjustment mechanism 8 it is possible to quickly and with little effort to raise the rotational axis 7 of the shaft 5 of the guide bar assemblage 6 from the knitting-technical mandated and finely tuned position O (analogous to the positions O and O in FIG. 1). The position O corresponds to a position which results in an easy accessibility of all of the guide needles 4, the individual guide bars 2, 3 of the guide bar assemblage 6. A good accessibility is required when, because of thread breaks a new threading-in of one or more threads into the holes 18 of guide needles 4 must be undertaken, and in instances also the innermost positioned guide bar 3 without a requirement of disconnecting the outer guide bars. In addition to the pivot and swing movement of the guide bar assemblage 6 which is derived from the pusher rod 11 and the pivot lever 10 (pusher rod 11 and pivot lever 10 correspond to FIG. 1), the pivot and swing movement can further be supported, especially when using large guide bar assemblages, by pivotably linking a further push rod 16 by way of a space lever 17 to the guide bar assemblage 6 which creates an optimal (more extended) movement of the guide needles. The required forces for the pivot and swing movement, are thereby more evenly applied over the shaft 5 as well as over the space lever 17.

Figure 3A:
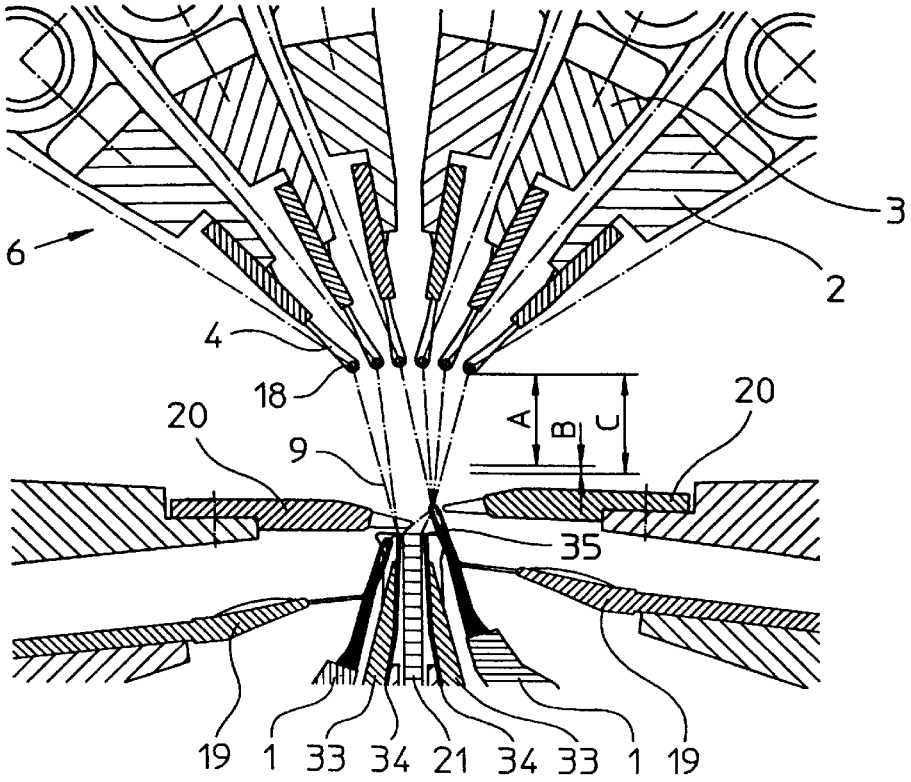
FIG. 3*a* is a side view of the area of the knitting elements with a guide bar assemblage having been lifted by the distance C.

FIG. 3*a* illustrates a side view of the knitting elements of a rashel machine according to the invention wherein the guide bar assemblage 6 is lifted into the position "1" by a distance C relative to the needle bar 1, respectively, the lay comb bar. The distance C is thereby measured so that sufficient room and accessibility has been provided for the threading-in of the threads into the holes 18 of the guide needles 4 including the innermost positioned guide bars 3. Threads 9 are being guided by the holes 19 of the guide needles 4 and from there are being guided to the knitting needles 1. The knitting needles work together with the slide needles that are arranged on the slide needle bar 19. The already knitted fabric 21 is being cast-off by way of the cast-off plates 34 which are arranged on cast-off sinker bars 33 and whose upper ends represent a cast-off edge and thereafter are guided between and through the cast-off sinker bars to a winding device. The stroke device illustrated in FIGS. 1 and 2 is of a simple construction and includes known adjustment mechanisms which allows for a quick adjustment of the position of the guide bar assemblage 6 by the distance A and also results, besides a good accessibility, in a user friendly serviceability.

Figure 3B:
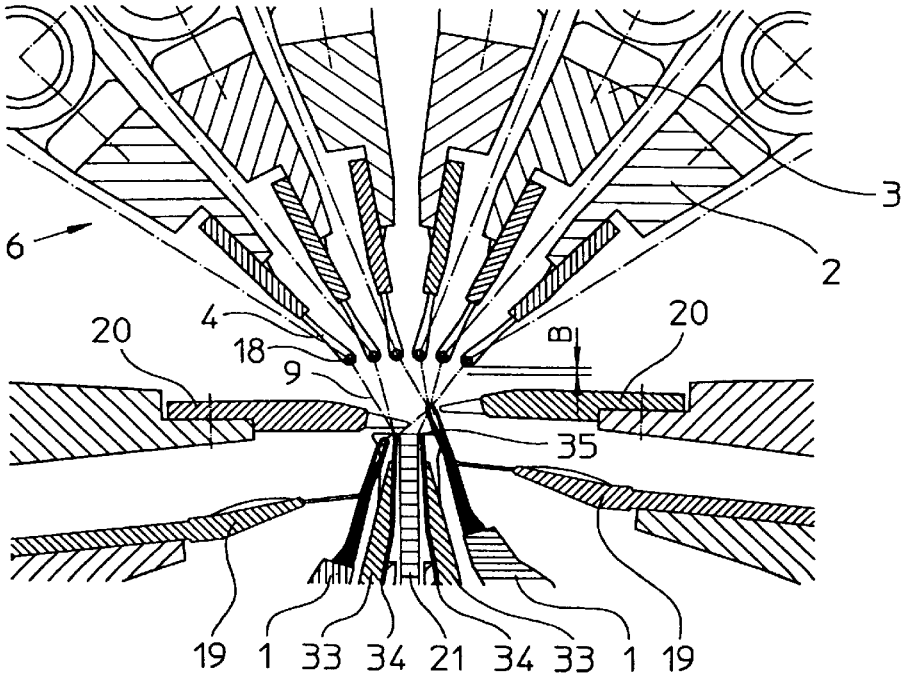
FIG. 3*b* is a side view of the area of the knitting elements with a guide bar assemblage having been lifted to the second adjustment path B.

In FIG. 3*b*, which corresponds to the illustration of FIG. 3*a* in its basic arrangement, the guide bar assemblage 6 with the inner positioned guide bars 3 and the outer positioned guide bars 2 is arranged in a position ② in which the distance of the guide needles 4 from the knitting-technical mandated fine adjustment position is illustrated by B. The movement of the guide bar assemblage 6 from the in FIG.

3*a* illustrated position ① into the in FIG. 3*b* illustrated position ② from the distance C to the distance B by way of the adjustment mechanism 8 can thereby be executed quickly without having to rely on a requirement of a high precision. The movement from the position ② into the knitting-technical mandated position (C minus B) must be obtained with a high exactitude and a corresponding fine adjustment. This is also realized by the use of the adjustment mechanism 8 which can be operated within certain margins with a differing exactitude.

Figure 4:
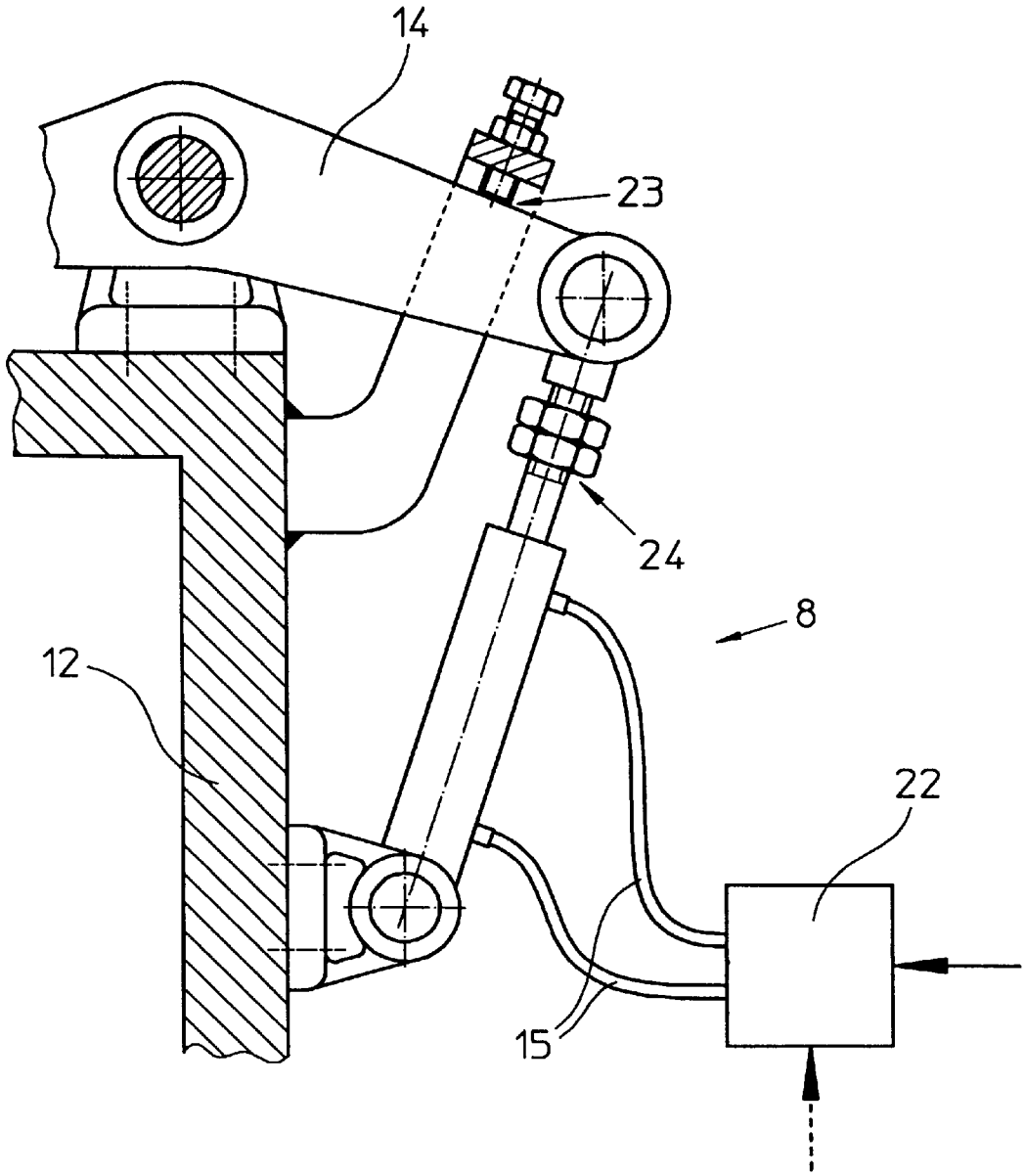
FIG. 4 is a detailed side view of a hydraulic stroke device according to a further embodiment of the invention.

FIG. 4 illustrates a detailed sectional and side view of a further example of an embodiment of a stroke device according to the invention. The pivot lever 14 again is fastened to an upper surface of the longitudinal machine beam 12. The stroke device itself is rotationally linked with a first end on the right side of the pivot lever 14. With its second end, the stroke device is also rotationally linked on a side of the longitudinal machine beam 12. In the illustrated example of the embodiment, the stroke device, that is, adjusting mechanism 8 is constructed as a hydraulic adjustment mechanism.

Therefore, two hydraulic connections 15 have been provided which relay signals from the hydraulic manifold 22 to which corresponding control signals have been delivered which supplies a hydraulic cylinder with the corresponding pressure energy. Because of the hydraulic cylinder (not shown), the distance between the first end and the second end of the adjustment mechanism is being changed. The pivot lever 14 is adjusted by way of a stop, which preferably can mechanically be adjusted, which is being supported on one side of the longitudinal machine beam 12. A second stop 24 is arranged on a piston rod as an elongation of the piston moving back and forth within the hydraulic cylinder so that a maximal distance between the guide needles 4 and the knitting needle bar (distance A) can be obtained. The first stop 23 determines the minimal distance of the guide needle bar 4 relative to the knitting needles 1. In the in FIG. 4 illustrated example of an embodiment, the first stop 23 as well as the second stop 24 can be adjusted by of a screw mechanism.

Figure 5:
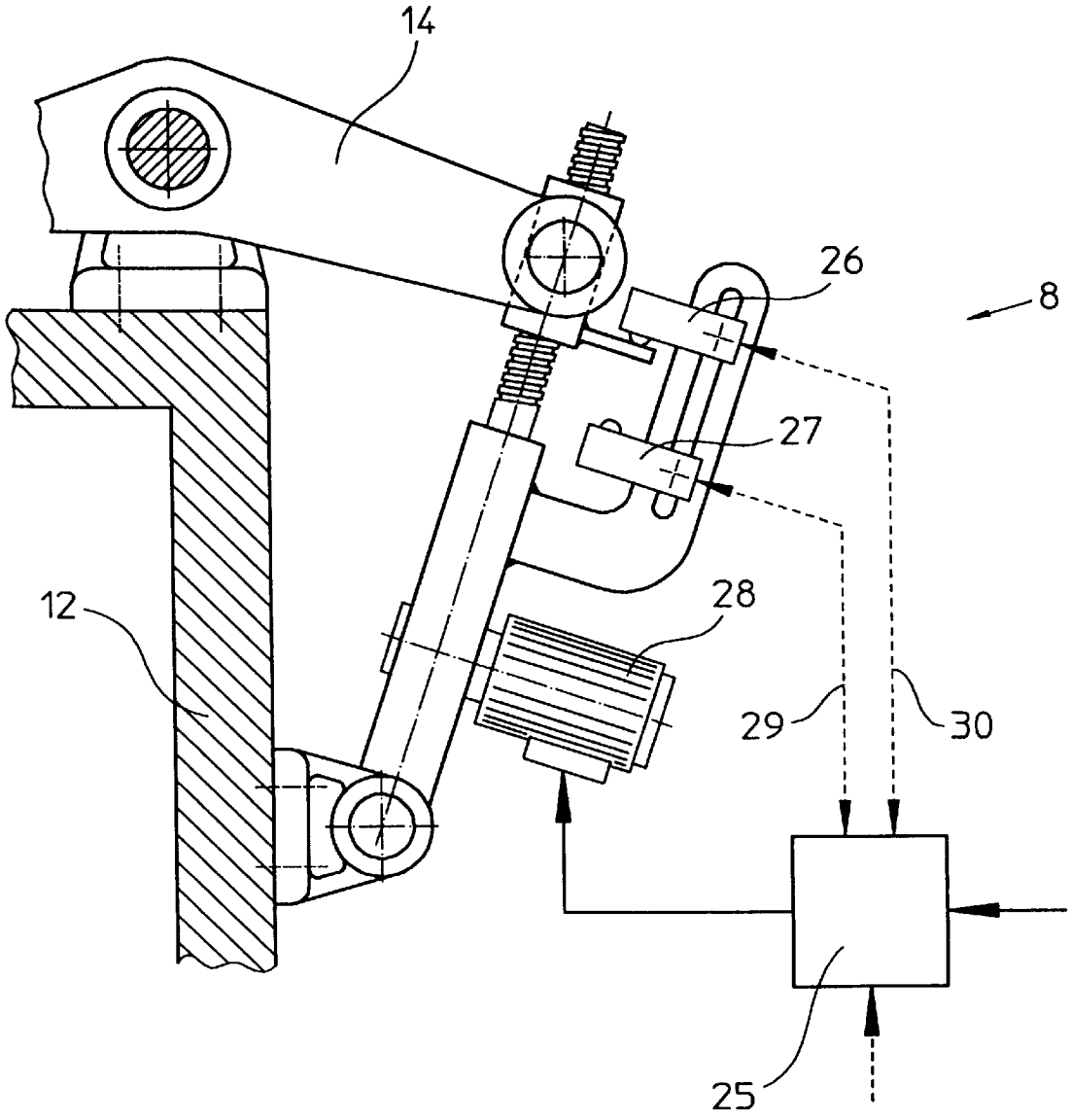
FIG. 5 is a detailed side view of a stroke device according to a further embodiment of the invention having an adjustment by way of an electric motor.

FIG. 5 illustrates a stroke device in the form of a stroke device 8 having adjustable stops 26, 27 that are, for example, position adjustable end switches. The basic construction is that of FIG. 4, however with the difference that the adjustment of the adjustment mechanism is not by hydraulics but electrically by way of an electric motor 28. The electric motor 28 as well as the first stop for the fixation of the minimal distance between the guide needles 4 and the knitting needles 1 and also the second stop for the fixation of the maximal distance between the guide needles 4 and the knitting needles 1 can be controlled by an electronic control device. This control device represents an energy and signal supply by which the electrical motor 28 realizes an adjustment of the stroke of the adjustment mechanism as well if need be renders the respective stops 26 as well as 27 to be adjustable by way of the corresponding signal lines 29 and 30.

Figure 6:
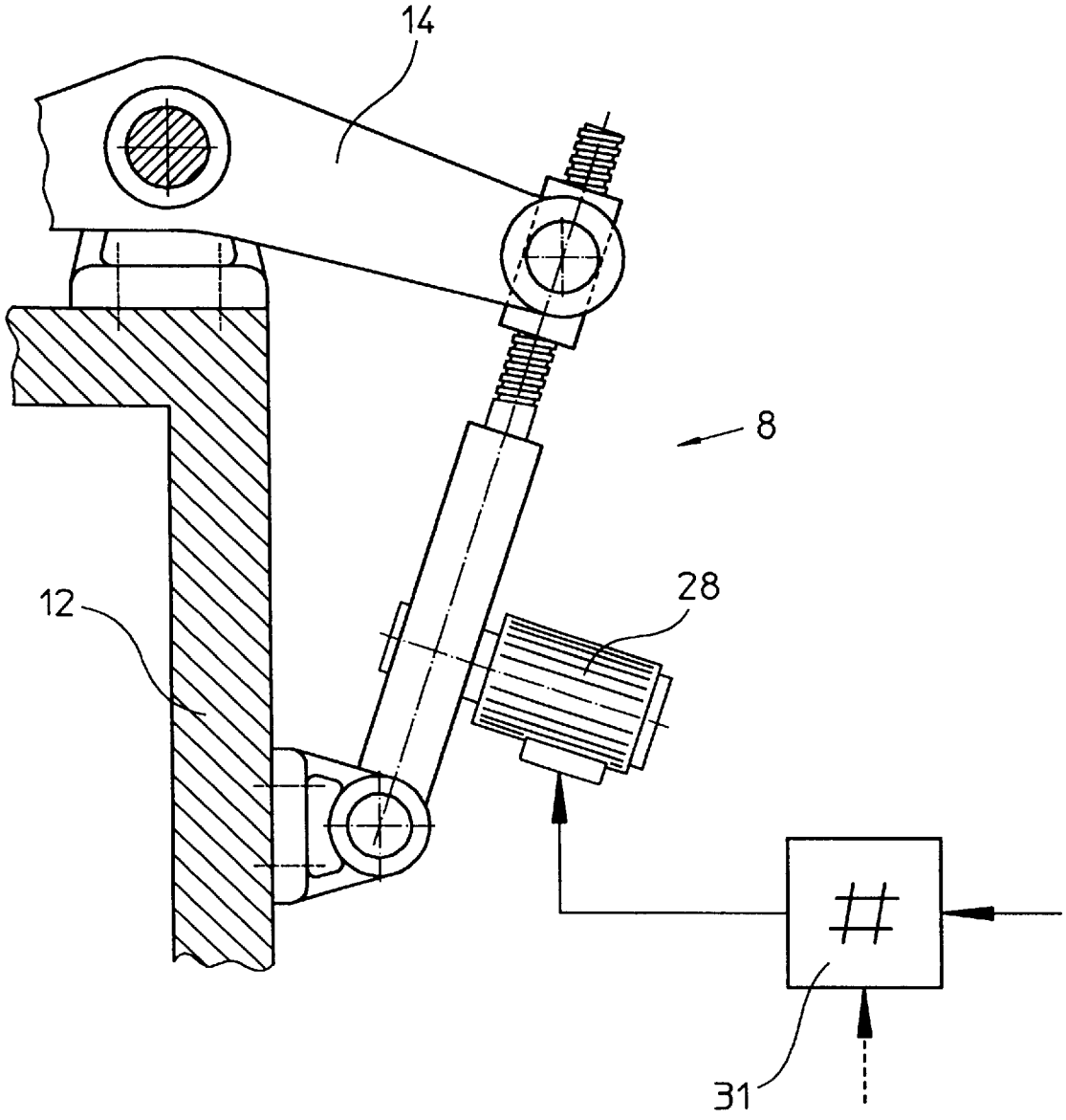
FIG. 6 is a detailed side view of a stroke device according to a further embodiment of the invention by way an electric motor and an intelligent computer.

FIG. 6 illustrates a stroke device as a further example of an embodiment of the invention. The basic construction of the adjustment device 8 and overall stroke device according to FIG. 6 corresponds to the illustration of FIG. 5. This adjustment mechanism does not include any mechanical stops. The stops for the adjusting device 8, that is, the maximal and minimal strokes are controlled by an electric motor 28 which preferably is formed as a stepping motor which by way of a control device including an integrated accumulator 31 in the form of an intelligent computer can be addressed. Predetermined positions of the guide needle bar assemblage 6 are stored in the accumulator 31 besides the electronically stored and also the adaptable stops at differing knitting-technical occurrences but must also be in tune with the casting off. Because of such an electronic control, respectively, activation of the adjustment mechanism 8, a great flexibility is guaranteed with respect to the matching of the most different occurrences and in controlling the differing strokes of the guide bar assemblage.

Figure 7:
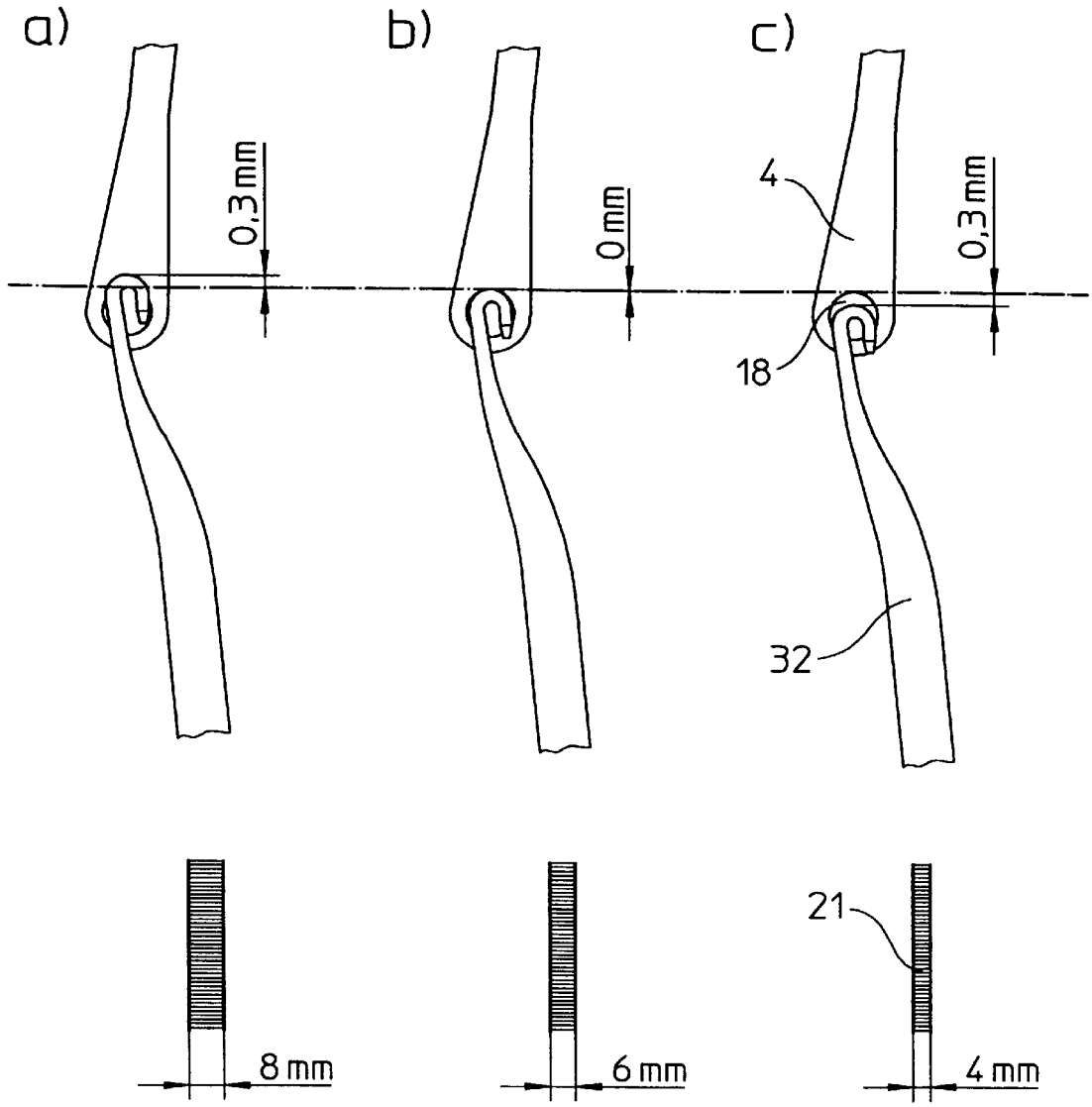
FIGS. 7*a*, 7*b*, and 7*c* are basic views of the fine adjustment of guide needles with regard to knitting needles for different width pol-fabrics.

FIG. 7 in a principal and exemplary manner the required position of the respective guide needle with regard to the uppermost tip of the head of the knitting needle with various fabric thicknesses of the knitted fabric 21. By way of example, it is assumed that the knitted fabric in the form of a space knitted fabric has a thickness of 6 mm. an optimal adjustment of the position with regard to the optimal stroke position of the knitting needle 32 is illustrated in FIG. 7*b* (middle illustration). This adjustment is therefore called the base adjustment. in such a base adjustment, by example, the uppermost tip, when the knitting needle 32 is in an optimal maximal stroke, is located at the height of the uppermost inner edge of the guide needle 4. When the uppermost tip of the knitting needle 32 coincides with the uppermost inner edge of the hole 18 of the knitting needle 4, a deviation of 0 mm occurs in the basic adjustment. when the fabric thickness changes, because of the production of another spaced knitted fabric, the position of the uppermost tip of the knitting needle 32 changes with regard to the uppermost inner edge of the hole 18 in the guide needle 4 as a result of the pivoting of the of knitting needle bar 1 (not shown in FIG. 7). When the fabric thickness changes to 8 mm, for example, as is shown in FIG. 7 (left illustration), the upper tip of the knitting needle 32 deviates from the uppermost inner edge of the hole 18 in guide needle 4 by 3 mm, for example. That means, that the position of the uppermost tip of knitting needle 32 with regard to the upper inner edge of the hole 18 of the guide needle 4 is off-set in the direction of the longitudinal axis of the guide needle, that is, in the direction of the guide bar. When the fabric thickness is decreased, which is shown by way of example in FIG. 7*c* (right illustration), to 4 mm, then the uppermost tip of the knitting needle 32 is by a measurement of 0.3 mm, for example, off-set from the uppermost inner edge of the hole 18 of the guide needle 4. In both cases, that is, when there is a deviation from the basic adjustment (reference fabric) with an increase or a decrease in fabric thickness, a fine adjustment of the position of the guide needles, and thereby the guide bar assemblage, with regard to the knitting needles and the knitting needle bar is required. This fine adjustment, as a rule, is undertaken only at the beginning of the knitting of a new knitted fabric or when changing the quality of the threads. This fine adjustment can also be undertaken permanently in a sense of an after adjustment or during a break-in period.

The adjustable stops 23, 24, respective, 26, 27 can be constructed as switches from which a signal can be guided to the hydraulic manifold 22 or to the control device 25, whereby from the control device 25, respectively, from the electronic unit (not shown) connected to the hydraulic manifold 22, a signal can be conveyed to the adjustment mechanism 8.

What we claim is:

1. A rashel machine for production of a knitted fabric (21) including a knitting needle bar (1) and a guide bar assemblage (6) having several guide bars (2, 3) with guide needles (4) with holes thereon, said guide bar assemblage (6) being supported on a shaft (5) having a rotational axis (7) whose stroke movement substantially in the direction relative to said knitting needle bar (1) is adjustable during a standstill of the machine, characterized in that said rotational axis is adjustable by such a distance (C) between a first position (①) and a second position (②) by an adjustment mechanism (8), whereby in said first position (①) a thread (9) is adapted to be threaded into the guide needles (4) including those supported by guide bars lying on an inside portion of the guide bar assemblage without having to disconnect guide bars lying on an outside portion of said guide bar assemblage (6), and said rotational axis (7) is further adjustable from said second position (②) by said adjustment mechanism (8) to a position in which said guide bar assemblage (6) is finely adjustable relative to said knitting needle (1) into a predetermined knitting position.

2. Rashel machine according to claim 1, characterized in that said adjustment mechanism (8) includes a first adjustment path (A) for said guide bar assemblage (6) which is insignificantly smaller than the distance (C) but executes quicker than a second adjustment path (B) which represents the difference between the distance (C) and said first adjustable path (A) when said adjustment mechanism (8) makes a fine adjustment for said guide bar assemblage (6) relative to said knitting needle bar (1) to the predetermined knitting position from the second position (②) and is directly adjustable into the predetermined knitting position when the fine adjustment for the respective knitted fabric (21) has concluded.

3. Rashel machine according to claim 1 or 2 characterized in that the adjustment mechanism (8) includes at least one adjustable stop (23, 24).

4. Rashel machine according to claim 3, characterized in that the stop (23, 24) is adjustable by electric or hydraulic means.

5. Rashel machine according to claim 1 including an accumulator (31) in which said predetermined knitting positions for said guide bar assemblage (6) can be deposited.

6. Rashel machine according to claim 1, characterized in that said adjustment mechanism (8) is adjustable by hydraulic or electric means.

7. Rashel machine according to claim 1, characterized in that said adjustment mechanism (8) is adjustable by means of an electric motor.

8. Rashel machine according to claim 1, characterized in that said adjustment mechanism (8) is controllable by signals generated by an electronic control device (25).

* * * * *